US009384653B2

(12) United States Patent
McCuen

(10) Patent No.: US 9,384,653 B2
(45) Date of Patent: Jul. 5, 2016

(54) SYSTEM AND METHOD FOR MONITORING AND SECURING A SUPERVISED OPENING

(71) Applicant: Rolland Safe and Lock Company LLC, Dallas, TX (US)

(72) Inventor: Frank Keith McCuen, Carrollton, TX (US)

(73) Assignee: ROLLAND SAFE AND LOCK COMPANY LLC, Dallas, TX (US)

( * ) Notice: Subject to any disclaimer, the term of this patent is extended or adjusted under 35 U.S.C. 154(b) by 251 days.

(21) Appl. No.: 13/940,871

(22) Filed: Jul. 12, 2013

(65) Prior Publication Data

US 2015/0015393 A1 Jan. 15, 2015

(51) Int. Cl.

| | |
|---|---|
| ***G08B 13/08*** | (2006.01) |
| ***G08B 25/00*** | (2006.01) |
| ***E05B 45/10*** | (2006.01) |
| ***E05B 65/10*** | (2006.01) |
| *E05B 45/06* | (2006.01) |
| *E05B 45/12* | (2006.01) |

(52) U.S. Cl.

CPC ..... *G08B 25/008* (2013.01); *E05B 45/06* (2013.01); *E05B 45/10* (2013.01); *E05B 65/108* (2013.01); *E05B 45/12* (2013.01); *E05B 2045/0635* (2013.01); *E05B 2045/0695* (2013.01); *G08B 13/08* (2013.01)

(58) Field of Classification Search

CPC ..... E05B 45/10; E05B 45/12
USPC ..... 340/527, 430
See application file for complete search history.

(56) References Cited

U.S. PATENT DOCUMENTS

| | | | | |
|---|---|---|---|---|
| 4,006,471 | A | 2/1977 | Pappas | |
| 4,920,333 | A * | 4/1990 | Barr | G08B 13/08 340/309.16 |
| 4,980,666 | A | 12/1990 | Hwang | |
| 5,311,168 | A * | 5/1994 | Pease, Jr. | E05B 45/06 200/61.93 |
| 5,677,672 | A | 10/1997 | Vogt | |
| 6,420,970 | B1 | 7/2002 | Kampmann | |
| 6,812,836 | B2 | 11/2004 | Soloway | |

(Continued)

OTHER PUBLICATIONS

EA-500 Information, http://www.lockproductos.com/archivos/DETEX%20EA500.pdf, Jul. 12, 2013.

(Continued)

*Primary Examiner* — Travis Hunnings
*Assistant Examiner* — Benyam Haile
(74) *Attorney, Agent, or Firm* — Andrews Kurth, LLP; Sean S. Wooden

(57) ABSTRACT

A method of securing an access point comprises transitioning to a first alarm state in response to: receiving an indication that the access point is open, sounding a first audible alarm in response to the open access point, silencing the first audible alarm and returning to the armed state in response to a disarming action by a user, transitioning to a first disarmed state in response to receiving an indication of the disarming action by the user, initiating a countdown from a first predetermined time period in response to the disarming action by the user, returning to the armed state upon the expiration of the first predetermined time period, transitioning to a second disarmed state in response to receiving an indication of a closed access point, and initiating a countdown from a second predetermined time period in response to a remaining first predetermined time period being greater than the second predetermined time period.

17 Claims, 5 Drawing Sheets

(56) References Cited

U.S. PATENT DOCUMENTS

| | | | | |
|---|---|---|---|---|
| 7,332,998 | B2 | 2/2008 | Beehler | |
| 7,339,472 | B2 | 3/2008 | Pierson | |
| 9,024,767 | B2 * | 5/2015 | Ramsay | G01F 1/662 340/506 |
| 2010/0052928 | A1 * | 3/2010 | Tabib | G08B 29/24 340/653 |

OTHER PUBLICATIONS

EAX Exit Alarms, EAX-500W, Battery Powered Door Mounted Weatherized Exit Alarm, Detex Corporation, Sep. 22, 2010.

EAX Exit Alarms, EAX-500, Battery Powered Door or Wall Mount Exit Alarm, Detex Corporation, Oct. 23, 2012.

Hoyles Electronic Development Ltd., www.hoyles.com; w:\MARKETING\ProductLeaflets\EX200.cdr, ExitGuard 24hr Door Alarm & Fire Door Checker; http://docs-europe.electrocomponents.com/webdocs/04d8/0900766b804d8917.pdf, Jul. 12, 2013.

Detex Corporation, Installation Instructions for the EAX-500 Exit Alarm (EAX-500 / 500W / 500SK), 101321, Mar. 8, 2013, pp. 1-7; http://www.qualifiedhardware.com/downloads/EAX-500%20New%20Instructions-3-13.pdf.

Von Duprin, Chexit Controlled Exit Device, 2001 Ingersoll-Rand Co., pp. 2-18, http://ronaldslockshop.com/Chexit.pdf.

Precision Hardware, Apex 2000 Series Delayed Egress, pp. 1-4, http://www.precisionhardware.com/index.asp?Mode=DE.

Von Duprin Installation Instructions—Electrical, 23928591, http://us.allegion.com/irstdocs/installinstructions/107082.pdf.

* cited by examiner

SYSTEM AND METHOD FOR MONITORING AND SECURING A SUPERVISED OPENING

FIELD

The present disclosure relates to the field of security and alarm systems and more particularly to a system and method for monitoring and securing a supervised opening or access point.

BACKGROUND

Commercial premises typically include more than one point of egress, which may be at least one front door and at least one back door. The front door is typically used by guests and customers, and the back door is typically a service entry used by employees and delivery personnel. The back door also may serve as a point of egress in emergency situations, but is typically locked or monitored.

Most commercial premises also have other types of openings or access points that may require security and monitoring, such as a door to a safe, locker, locker room, office, etc. It is desirable to provide a system and method that may be used to secure and monitor all such openings to prevent unauthorized access and minimize theft.

DETAILED DESCRIPTION

Figure 1:
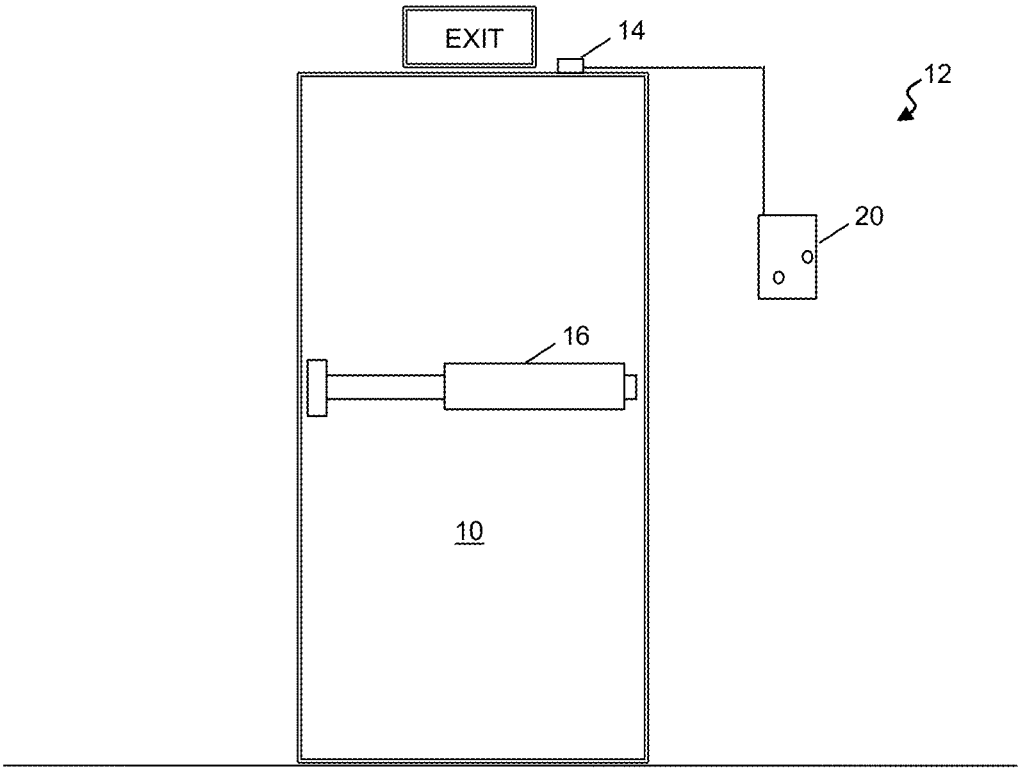
FIG. 1 is a simplified diagram illustrating a secured opening or access point according to an exemplary embodiment of the present disclosure.

FIG. 1 is a simplified diagram illustrating a point of egress or access point 10 according to an exemplary embodiment of the present disclosure. For some commercial operations, the back door or emergency exit door 10 is unlocked but monitored using a sensor 14 such as a contact switch, which may be a magnetic contact or proximity sensor or the like. The door 10 may also be monitored by detecting depression or activation of the door handle bar 16, for example. The door sensor 14 is coupled to an alarm control box 20. When the door 10 is opened while the system 12 is armed, an acoustic and/or visual alert would be triggered to signal unauthorized entry. The alarm system 12 may be armed and disarmed using a key or a predetermined key code.

The system 12 may be temporarily disarmed to permit a delivery person to bring in a shipment of merchandize or other supplies, for example, without triggering the alarm. However, a common problem with conventional alarm systems occurs when the user fails to re-arm the system when delivery is completed. According to the present disclosure, when the system is disarmed, a timer set to a predetermined time period begins to count down. When the time is up as indicated by the timer, the system 12 automatically re-arms, so that the door 10 is once more secure and monitored for unauthorized access without requiring manual intervention.

Figure 2:
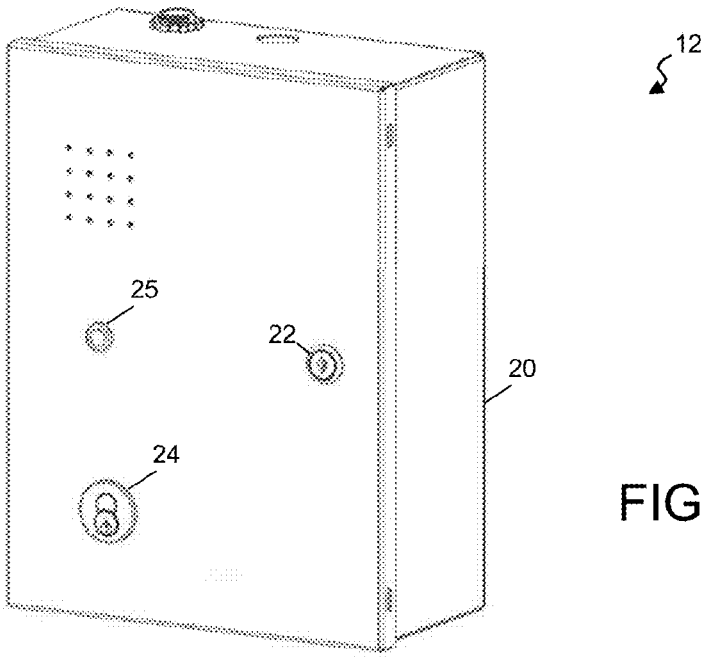
FIG. 2 is a perspective view of the system and method for monitoring and securing an opening or access point according to an exemplary embodiment of the present disclosure.

FIG. 2 is a perspective view of the system and method 12 for monitoring and securing an opening or access point according to an exemplary embodiment of the present disclosure. The system 12 includes an alarm control box 20 that encloses and protects the alarm circuitry. The alarm control box 20 is preferably constructed of sturdy and rigid materials such as metal, composite materials, etc. that can withstand tampering and other destructive forces. Weatherproofing may also be desirable for control boxes that are exposed to the elements. The alarm control box 20 is preferably secured by a lock 22 to prevent unauthorized access. A mortise lock cylinder 24 is further provided as the means to arm and disarm the alarm system. Preferably, the mortise lock cylinder 24 is keyed-alike with other mortise lock cylinders used on the premises so that users are not required to keep and maintain an extra set of keys to operate the alarm system 12. A visual indicator 25, such as an LED (light emitting diode) is installed in the control box 20 so as to be visible to users. The visual indicator may include one or more LEDs, an LCD (liquid crystal display) panel, a touch display, or other forms of visual interface devices.

Additionally or as an alternative to the mortise lock cylinder 24 and key combination, a numerical keypad (not explicitly shown) may be used to arm and disarm the system. For example, the user is required to supply or enter a unique numerical sequence on the keypad in order to arm or disarm the system. The control box key switch and the secondary exterior key switch both employ End of Line Resistors (EOLR) to supervise field wiring for open and short circuit conditions.

The alarm control box 20 may be installed near the opening or access point to be monitored or in a management office, for example. A secondary alarm control panel, key switch, or keypad may be installed near the opening or access point on an exterior wall to facilitate arming and disarming from the outside, if desired.

Figure 3:
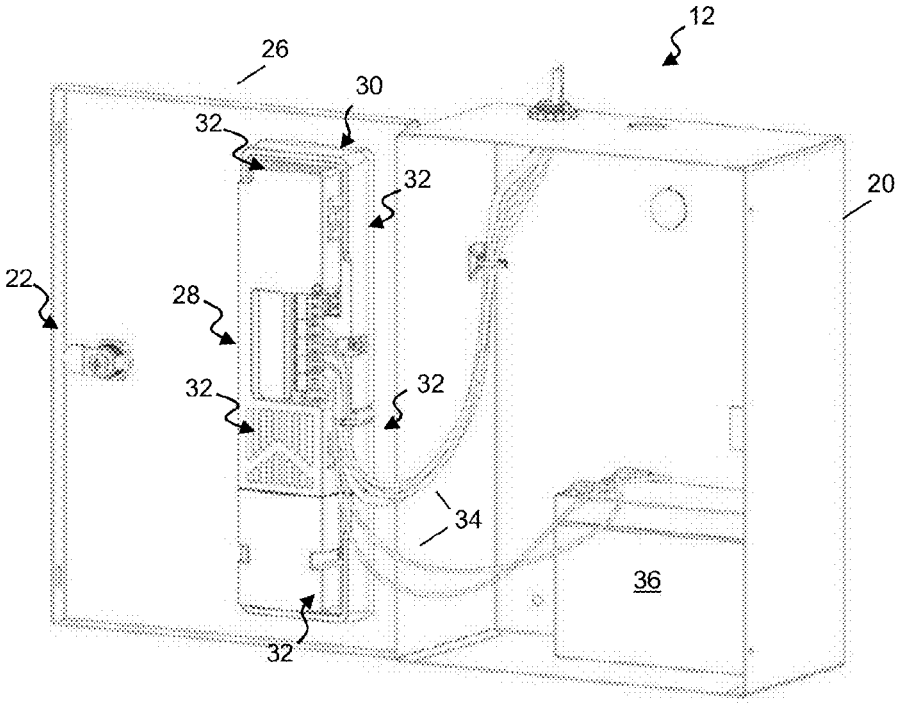
FIG. 3 is a perspective view of the system and method for monitoring and securing an opening or access point according to an exemplary embodiment of the present disclosure.

FIG. 3 is a perspective view of the system and method 12 for monitoring and securing an opening or access point according to an exemplary embodiment of the present disclosure. The alarm control box 20 preferably has a hinged lid 26 upon which the electronic circuitry 28 is mounted. The electronic circuitry 28 is mounted within and protected with a housing 30 that further shield it from dust, debris, and the elements. The housing 30 comprises a number of ventilation openings 32 to enable dissipation of heat and cooling of the circuitry. Coupled to the electronic circuitry 28 are a number of electrical wires 34 that lead to a backup rechargeable battery 36 also housed within the control box 20, and to sensors that monitor the secured opening.

Figure 4:
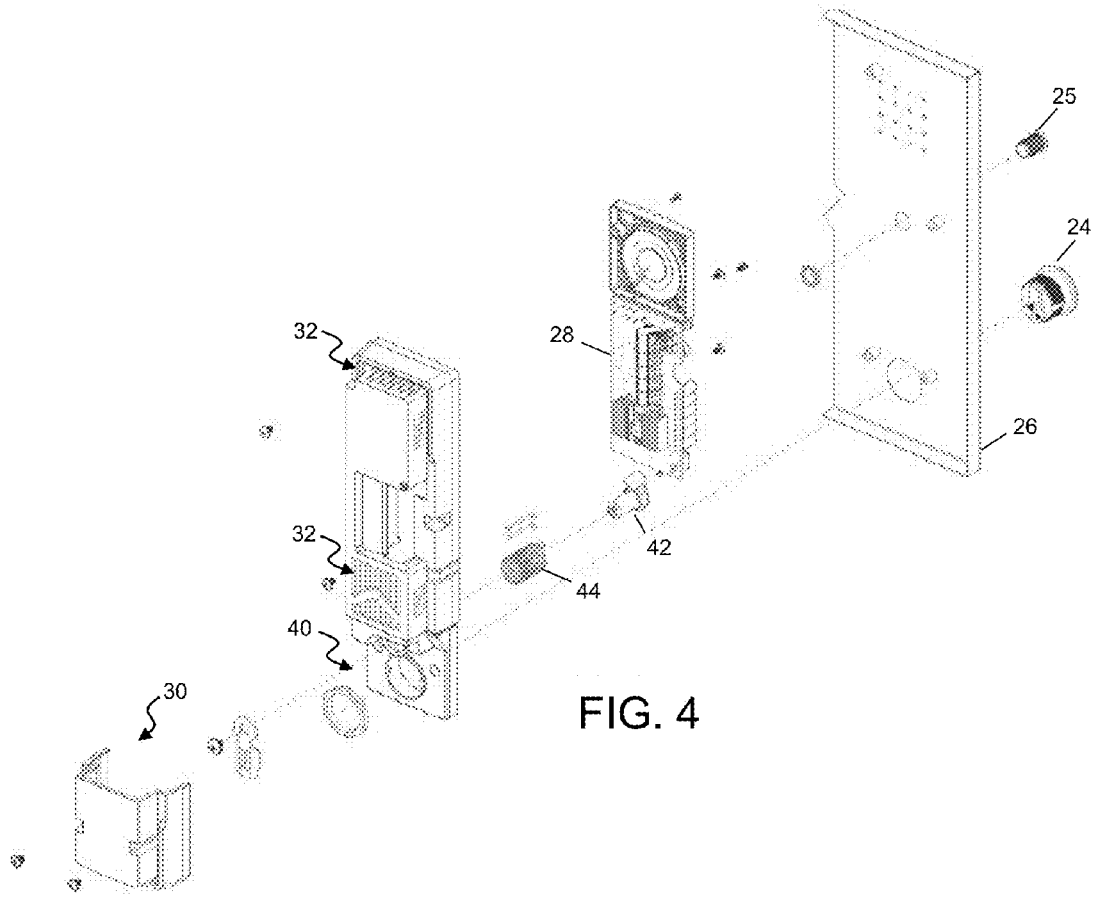
FIG. 4 is an exploded view of a portion of the system and method for monitoring and securing an opening or access point according to an exemplary embodiment of the present disclosure.

FIG. 4 is an exploded view of a portion of the system and method 12 for monitoring and securing an opening or access point according to an exemplary embodiment of the present disclosure. As described above, a mortise lock cylinder 24 is preferably provided as the means to arm and dis-arm the alarm system 12. Preferably, the mortise lock cylinder 24 may be or has the capability to be keyed-alike with other mortise lock cylinders of exterior doors at the premises so that users are not required to keep and maintain an extra set of keys to operate the alarm system 12. The mortise lock cylinder 24 is mounted within a circular opening formed in the lid 26 of the control box 20 that matches up to a cylindrical cavity 40 designed to accept the mortise lock cylinder 24. A lever arm or cam 42 biased by a spring element 44 is coupled to the mortise cylinder of the lock 24 so that when the key is inserted into the mortise cylinder and turned from a first position to a second position, the action of the spring 44 brings the key back to the first position. When the key is turned to the second position, the position of the key or the lever arm causes the alarm system 12 causes a signal to be transmitted to a microprocessor monitoring the position of the key. The result is temporary disarming of the system for a predetermined period of time. When the predetermined time period expires, the alarm system 12 is operable to automatically revert back to the armed state.

Figure 5:
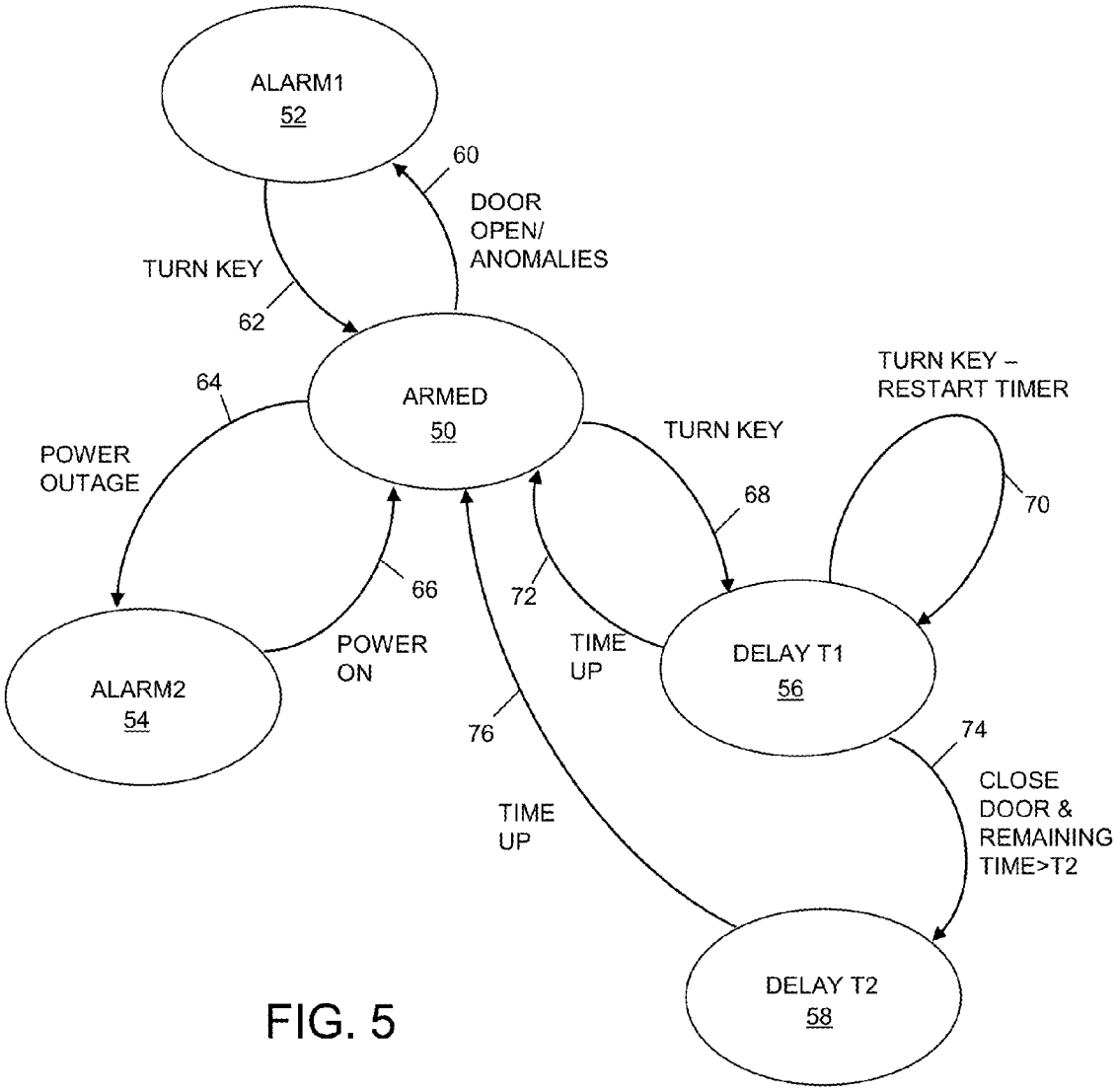
FIG. 5 is a simplified state diagram illustrating the operations of the system and method for monitoring and securing an opening or access point according to an exemplary embodiment of the present disclosure.

FIG. 5 is a simplified state diagram of the system and method 12 for monitoring and securing an opening according to an exemplary embodiment of the present disclosure. The system and method 12 are operable in five states: ARMED 50, ALARM1 52, ALARM2 54, DELAY T1 56, and DELAY T2 58. In operation, the alarm system 12 is, by default, in the ARMED state 50 upon power-up. The system may provide a visual indicator to indicate its current state. For example, the LED indicator 25 may emit a steady red light to indicate the ARMED state. Alternatively, a display may provide a textual status such as: SYSTEM ARMED.

In the ARMED state 50, any opening of the door or opening being monitored automatically results in a transition to the ALARM 1 state 52, as indicated by arrow 60. Additionally, anomalies or error conditions, such as the supervised EOLR (end of line resistor) wires detecting cut (open circuit) or shorted (short circuit) conditions would also trigger the transition from the ARMED state 50 to the ALARM 1 state 52. The control box key switch and the secondary exterior key switch both employ EOLR to supervise field wiring for open and short circuit conditions.

In the ALARM 1 state 52, an audible alarm sound that repeats at predetermined time intervals is triggered. The system 12 may additionally trigger the visual indicator to provide the user a visual indicator of the state change. For example, the LED indicator 25 may emit a blinking red light. Alternatively, a display may provide a textual status such as: DOOR OPEN. The audible alarm repeats until the opening or access point has been restored to the closed or ready position, or the correct key is used to disarm the alarm (turning the key from the first position to the second position), at which time the audible alarm is silenced and the system automatically returns to the ARMED state 50, as indicated by arrow 62.

In the ARMED state 50, any AC power outage results in a transition to the ALARM 2 state 54, as indicated by arrow 64. In the ALARM 2 state 54, the system 12 automatically switches to a backup power source, such as a rechargeable battery. Further, an audible alarm that repeats is triggered. The audible alarm for the ALARM 2 state 54 indicating power outage is preferably distinguishable from the alarm sounded in the ALARM1 state 52. The ALARM2 audible alarm may incorporate longer intervals of silence in order to conserve the power in the backup rechargeable battery. The system 12 may additionally trigger the visual indicator to provide the user a visible indication of a loss of power. For example, the LED indicator 25 may emit a blinking yellow light. Alternatively, a display screen may provide a textual status such as: POWER OUT. The audible alarm repeats until the AC power is back on, at which time the audible alarm is silenced and the system automatically switches to the AC power and returns to the ARMED state 50, as indicated by arrow 66.

In the ARMED state 50, a user may insert the correct key into the mortise lock cylinder and turn the key to the second position, which results in a transition to the DELAY T1 state 56, as indicated by arrow 68. In the DELAY T1 state 56, the system 12 automatically starts a count down from a predetermined time, T1. During time T1, any opening of the door or access point being monitored does not result in setting off of the audible alarm. The monitored opening or access point may be kept open to enable personnel, such as a delivery person, to transport shipment into the facilities during this time. The system 12 may provide a visual indicator of the current state, such as having the LED indicator 25 emit a steady green light. Alternatively, a display may provide a textual status such as: DISARMED. The system may provide an audible alert when the timer approaches expiration, such as providing a short beep to indicate that time is almost up. At this time, or at any time during T1, the user may use the correct key and turn the key to the second position to reset the timer to gain more time for entry, as indicated by arrow 70. There is no limit on the number of times the timer may be reset to keep the system in the DELAY T1 state 56. Alternatively, there may be a user setting that limits the number of restarts that are permitted.

If the countdown from T1 expires, the system 12 automatically transitions to the ARMED state 50, as indicated by arrow 72. However, if the opening or access point is still open when the timer expires, then the system automatically transitions to the ALARM1 state 52 (arrow 60) and the audible alarm is sounded.

If while in the DELAY T1 state 56, the monitored opening or access point closes when the remaining time on the timer is greater than a predetermined time period, T2, then the system automatically transitions to a DELAY T2 state 58, as indicated by arrow 74. In the DELAY T2 state 58, a second timer of time T2 is started, and the expiration of T2 causes the system 12 to automatically return to the ARMED state 50, as indicated by arrow 76.

If the monitored opening or access point closes when the remaining time on the timer is less than or equal to the predetermined time period, T2, then the system stays in the DELAY T2 state 58 and keeps counting down to zero, at which time the system automatically returns to the ARMED state 50.

As an example, the time period T1 may be set to 5 minutes, and the time period T2 may be set to 30 seconds. If the opening being monitored closes when the timer still has 3 minutes remaining, the system automatically transitions to the DELAY T2 state 58 (because 3 minutes is greater than 30 seconds), and the timer is set to T2 or 30 seconds. As soon as T2 or 30 seconds are up, the system returns to the ARMED state 50. Operating in this manner, the DELAY T2 state 58 enables a quicker transition back to the ARMED state 50 since the user closed the opening, which is indicative of completion of entry or exit. The DELAY T2 state 58 thus enables the system to returned to the ARMED state 50 sooner instead of spending unnecessary time in the unarmed state to minimize opportunities for unauthorized access.

Figure 6:
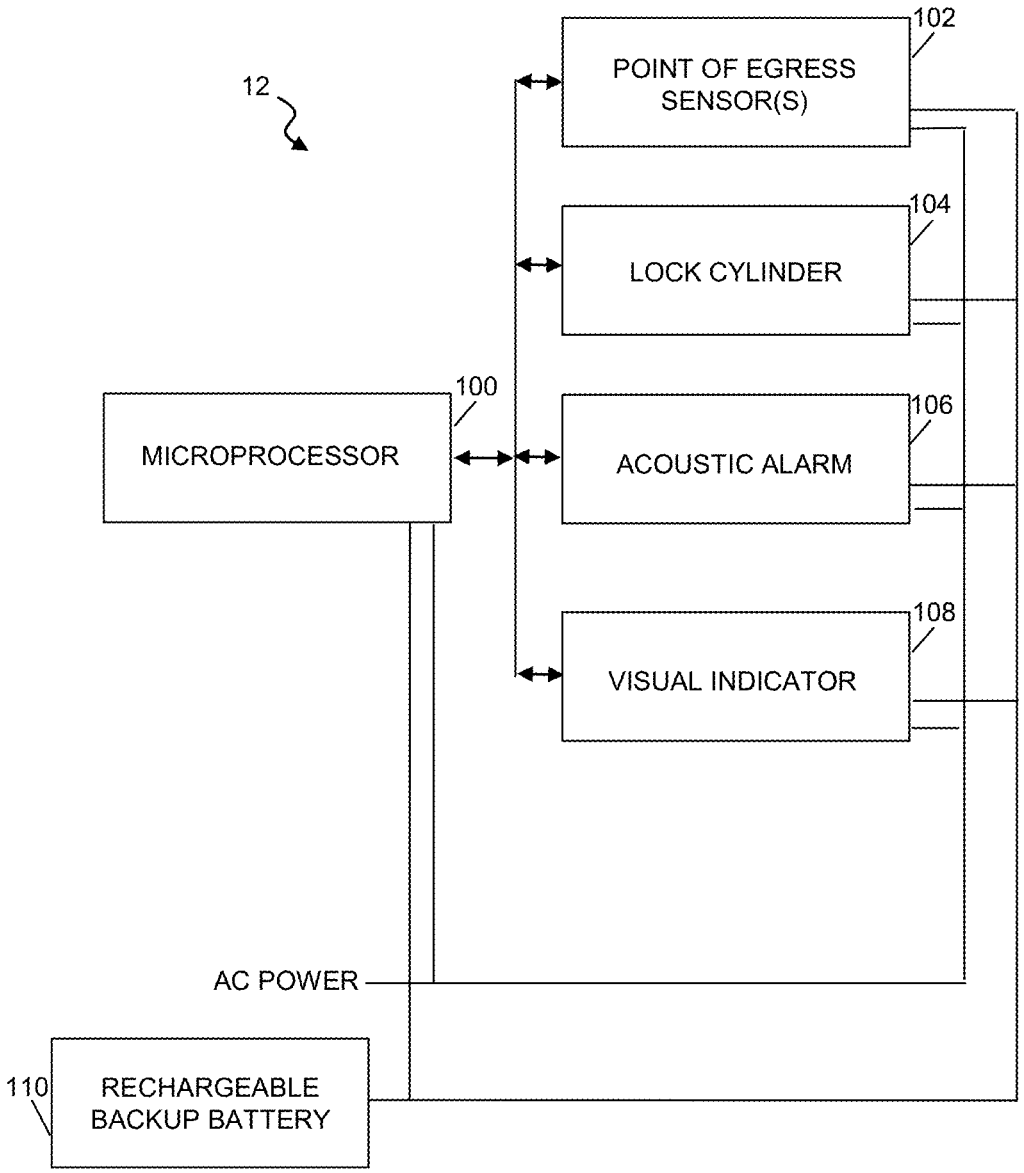
FIG. 6 is a simplified block diagram of the system and method for monitoring and securing an opening or access point according to an exemplary embodiment of the present disclosure.

FIG. 6 is a simplified block diagram of the system and method 12 for monitoring and securing an opening or access point according to an exemplary embodiment of the present disclosure. The system 12 includes a microprocessor or microcontroller 100 that is operable to execute software code to perform mathematical, logical, and other computing operations. Although not shown explicitly, the microprocessor 100 includes or is coupled to memory devices (RAM, ROM, PROM, EPROM, EEPROM, etc.) that store software code, user-programmed data, and other data. Also not shown explicitly are dip switches that may be used by the user to easily set program parameters, such as the time periods T1 and T2, for example. The microprocessor 100 is further coupled to one or more sensors 102 that are used to monitor and detect the opening of the door (e.g., exit door, fire door, safe door, locker door, locker room, etc.) or access point, or the activation (depressing) of the door's handle bar. The sensor 102 is operable to generate and transmit wired or wireless signals to the microprocessor 100. The microprocessor 100 is also coupled to the mortise lock cylinder 104 and operable to detect when the key is turned to the second position to disarm the system. The microprocessor 100 is further coupled to an acoustic alarm 106, and is operable to generate and amplify the audible alarm sounds, as described above. The microprocessor 100 is further coupled to a visual indicator 108, and is operable to instruct it to provide a visual indication of the current state of the system, as described above. The visual indicator 108 may include one or more LEDs, display screens, etc. AC power is coupled to all of the circuitry components, and a battery 110 is further coupled to the circuitry components to provide backup power as necessary. Preferably the battery 110 is a rechargeable battery.

The features of the present invention which are believed to be novel are set forth below with particularity in the appended claims. However, modifications, variations, and changes to the exemplary embodiments described above will be apparent to those skilled in the art, and the system and method described herein thus encompass such modifications, variations, and changes and are not limited to the specific embodiments described herein.

What is claimed is:

1. A method of monitoring and securing an access point, comprising:

being in an armed state;

transitioning to a first alarm state in response to receiving an indication that the access point is open, wherein the first alarm state includes:

sounding a first audible alarm in response to the open access point;

silencing the first audible alarm and returning to the armed state in response to a disarming action by a user;

transitioning to a second alarm state in response to receiving an indication of a power outage, wherein the second alarm state includes:

switching to a backup power supply;

sounding a second audible alarm in response to the power outage; and silencing the second audible alarm and returning to the armed state in response to a resumption of power;

transitioning to a first disarmed state in response to receiving an indication of the disarming action by the user, wherein the first disarmed state includes:

initiating a countdown from a first predetermined time period in response to the disarming action by the user;

returning to the armed state upon the expiration of the first predetermined time period; and restarting the countdown from the first predetermined time period in response to a repeating disarming action by the user; and transitioning to a second disarmed state in response to receiving an indication that the access point is closed, wherein the second disarmed state includes:

initiating a countdown from a second predetermined time period in response to a remaining first predetermined time period being greater than the second predetermined time period and transitioning back to the armed state upon expiration of the second predetermined time period;

continuing to countdown from the first predetermined time period and transitioning back to the armed state upon the expiration of the first predetermined time period in response to the first predetermined time period less than or equal to the second predetermined time period.

2. The method of claim 1, wherein the second audible alarm comprises longer periods of silence than the first audible alarm.

3. The method of claim 1, wherein the second predetermined time period is shorter than the first predetermined time period.

4. The method of claim 1, wherein the disarming action by a user comprises:

inserting a key into a mortise lock cylinder; and turning the key from a first position to a second position.

5. The method of claim 1, further comprising receiving a user input of a limit on the number of times for the disarming action by the user to restart the countdown from the first predetermined time period.

6. A method of monitoring and securing an access point, comprising:

being in an armed state;

transitioning to a first alarm state in response to receiving an indication that the access point is open, wherein the first alarm state includes:

sounding a first audible alarm in response to the open access point; and silencing the first audible alarm and returning to the armed state in response to a disarming action by a user;

transitioning to a first disarmed state in response to receiving an indication of the disarming action by the user, wherein the first disarmed state includes:

initiating a countdown from a first predetermined time period in response to the disarming action by the user;

returning to the armed state upon the expiration of the first predetermined time period; and restarting the countdown from the first predetermined time period in response to a repeating disarming action by the user; and transitioning to a second disarmed state in response to receiving an indication that the access point is closed, wherein the second disarmed state includes:

initiating a countdown from a second predetermined time period in response to a remaining first predetermined time period being greater than the second predetermined time period and transitioning back to the armed state upon expiration of the second predetermined time period;

continuing to countdown from the first predetermined time period and transitioning back to the armed state upon the expiration of the first predetermined time period in response to the first predetermined time period less than or equal to the second predetermined time period.

7. The method of claim 6, comprising:

from the armed state, transitioning to a second alarm state in response to:

receiving an indication of a power outage;

switching to a backup power supply; and sounding a second audible alarm in response to the power outage; and silencing the second audible alarm and returning to the armed state in response to a resumption of power.

8. The method of claim 7, wherein the second audible alarm comprises longer periods of silence than the first audible alarm.

9. The method of claim 6, wherein the second predetermined time period is shorter than the first predetermined time period.

10. The method of claim 6, wherein the disarming action by a user comprises:

inserting a key into a mortise lock cylinder; and turning the key from a first position to a second position.

11. The method of claim 6, further comprising receiving a user input of a limit on the number of times for the disarming action by the user to restart the countdown from the first predetermined time period.

12. A system of monitoring and securing an access point, comprising:

a sensor adapted to detect an open access point and generating a signal in response to the detected open access point; an audible alarm; a visual indicator; a mortise lock cylinder adapted to receive a unique key, and being rotatable from a first position to a second position by the unique key;

a microprocessor coupled to the sensor and being adapted to receive the access point opening signal, and coupled to the mortise lock cylinder and being adapted to receive an indication of the unique key turning from a first position to a second position;

the microprocessor further adapted to:

issue an instruction to sound the audible alarm in response to an open access point, and issue an instruction to silence the audible alarm in response to receiving the indication of the unique key turning from the first position to the second position;

issue an instruction to start a first timer in response to receiving the indication of the unique key turning from the first position to the second position, and issue an instruction to sound the audible alarm in response to an open access point when the first timer expires;

issue an instruction to restart the first timer in response to receiving the indication of the unique key turning from the first position to the second position prior to the expiration of the first timer, and issue an instruction to sound the audible alarm in response to an open access point when the restarted first timer expires;

issue an instruction to start the first timer in response to receiving the indication of the unique key turning from the first position to the second position, and issue an instruction to start a second timer in response to detecting a closed access point when time remaining on the timer is greater than the time on the second timer, and sound the audible alarm in response to an open access point when the second timer expires; and issue an instruction to sound the audible alarm, switch to a backup power supply, in response to detecting a loss of AC power, and issue an instruction to silence the audible alarm and switch back to AC power in response to detecting availability of AC power.

13. The system of claim 12, wherein the visual indicator comprises a light emitting diode.

14. The system of claim 12, wherein the backup power supply comprises a rechargeable battery.

15. The system of claim 12, wherein a control box houses the microprocessor, mortise lock cylinder, acoustic alarm, visual indicator, and backup power supply.

16. The system of claim 12, wherein the mortise lock cylinder is keyed to the unique key that is operable to open other secured access points on premises.

17. The system of claim 12, wherein the sensor comprises EOLR (end of line resistor).

* * * * *